United States Patent [19]

Roller et al.

[11] 3,954,082

[45] May 4, 1976

[54] MOTOR HOUSING FOR AN ELECTRIC TROLLING MOTOR

[75] Inventors: William G. Roller, Purdy, Mo.; Emery L. West, Oklahoma City, Okla.

[73] Assignee: William G. Roller, Purdy, Mo.

[22] Filed: Nov. 22, 1974

[21] Appl. No.: 526,234

Related U.S. Application Data

[63] Continuation of Ser. No. 393,779, Sept. 4, 1973, abandoned.

[52] U.S. Cl. ..... 115/18 E; 310/87

[51] Int. Cl.[2] ..... B63H 21/26; H02K 5/12

[58] Field of Search ..... 115/17, 18 E; 310/87

[56] References Cited

UNITED STATES PATENTS

| | | | |
|---|---|---|---|
| 2,824,984 | 2/1958 | Harris | 115/18 E |
| 2,944,297 | 7/1960 | Maynard | 310/87 |
| 3,593,050 | 7/1971 | Ware | 115/18 E |
| 3,791,331 | 2/1974 | Dilley | 115/17 |
| 3,814,961 | 6/1974 | Nelson et al. | 115/18 E |

*Primary Examiner*—Trygve M. Blix
*Assistant Examiner*—Charles E. Frankfort
*Attorney, Agent, or Firm*—Lowe, Kokjer, Kircher, Wharton & Bowman

[57] ABSTRACT

A housing and sealing gasket encapsulating an unsealed DC motor for submerged use in water. The motor is held within the housing by means of a sealing composition and a biasing end cap to prevent motor vibrations. The sealing gasket disposed within a bearing cup receives the work shaft of the motor protruding from the housing. A flexible collar of the gasket engages the work shaft and is encircled by a biasing spring to insure effective sealing.

2 Claims, 4 Drawing Figures

MOTOR HOUSING FOR AN ELECTRIC TROLLING MOTOR

This application is a continuation of Ser. No. 393,779, filed Sept. 4, 1973 entitled "Motor Housing for an Electric Trolling Motor", and now abandoned.

BACKGROUND AND SUMMARY OF THE INVENTION

This invention relates to an electric motor housing. More particularly, the invention relates to a method and apparatus for encapsulating an unsealed DC motor to adapt such motor to operations submerged in water as for an electric trolling motor of a boat.

In recent years, fishermen have come to rely on an electric outboard motor, generally known as a "trolling motor", for boating noiselessly through water without alarming wary fish. Power for such motors is commonly supplied by a direct current voltage source, such as a wet cell DC battery, carried aboard the boat.

Electric trolling motors of this type characteristically fall into one of two categories. The hand operated type of trolling motor includes an elongate shaft having a water tight direct current motor equipped with a propeller on the work shaft. Electrical leads from the motor extend up through the elongate shaft to a control lever having a handle for rotating the direction of the motor and having a switch and/or speed control for operating the motor. Electrical leads from the control handle are connected to the power source. The second type of trolling motor is commonly referred to as a remote control or foot operated trolling motor and enables the fisherman to have free use of his hands since directional control of the motor as well as on-off operation and/or speed control is accomplished by the foot acting on a pedal lever which has the necessary switch and any speed control associated therewith.

Heretofore, both of the foregoing types of electric trolling motors have employed a sealed DC motor which is necessary to prevent water from seeping into the motor when it is submerged in water during normal operation. The necessity of using sealed motors represents a significant portion of the total expense of an electric trolling motor. It also represents a significant and time consuming maintenance problem, which, if repair or replacement is dictated, is likewise expensive.

Consequently, there is a need in the field of electric trolling motors for a method of effectively employing an unsealed DC motor in water submerged operations. The primary goal of this invention is to fulfill this need.

More specifically, an object of this invention is to provide the method and apparatus for encapsulating an unsealed DC electric motor in a water tight housing to permit use as the motor and propeller unit of an electric trolling motor.

Another object of the invention is to provide an encapsulated unsealed DC motor for an electric trolling motor having a strong and water impervious housing to prevent water damage to the unsealed motor.

An additional object of the invention is to provide an encapsulated unsealed electric motor for an electric trolling motor wherein the motor is rigidly held within the housing in order to prevent vibrational damage and thereby insure a long and useful life of the unit.

Another object of the invention is to provide an encapsulation housing for an unsealed DC motor of the character described wherein the motor work shaft is bearingly received with respect to the housing in order to permit rotation of the work shaft and is also effectively sealed thereagainst in order to prevent water seepage around the work shaft.

Other and further objects of the invention, together with the features of novelty appurtenant thereto, will appear in the course of the following description of the drawing.

DESCRIPTION OF THE DRAWING

In the accompanying drawing, which forms a part of the specification and is to be read in conjunction therewith, and in which like reference numerals are employed to indicate like parts in the various views:

Referring to the drawing in greater detail, FIG. 1 illustrates a typical application of the propulsion unit housing which comprises the subject of this invention. A remote control type of trolling motor, generally designated by the numeral 10, is shown mounted on the bow of a boat 11 by means of a bracket assembly 12. The trolling motor 10 includes an upper housing **10*a* having electrical leads 10*b* connected to the on-off switch and/or motor speed control located on a foot operated pedal mechanism 10*c*. Electrical leads 10*d* from such switching are connected to a suitable voltage source 13, such as a wet cell DC battery. A cable 10*e* from the pedal 10*c* is connected to the directional control housing 10*f* of the trolling motor which rotatably turns an elongate shaft 10*g* extending from the upper housing 10*a* to the propulsion unit 14** mounted on the lower end thereof.

Figure 2:
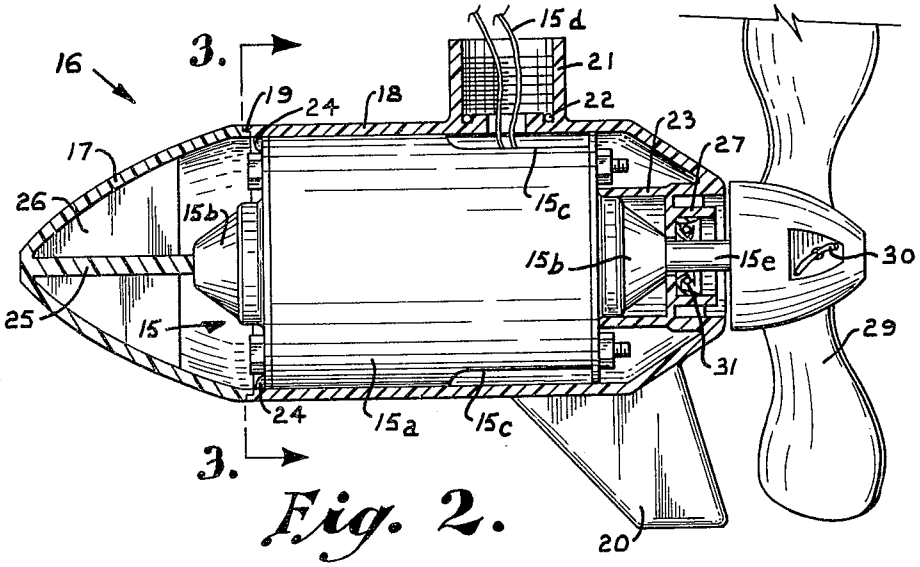
FIG. 2 is a side sectional view through the motor unit housing constructed in accordance with a preferred embodiment of this invention.
Figure 4:
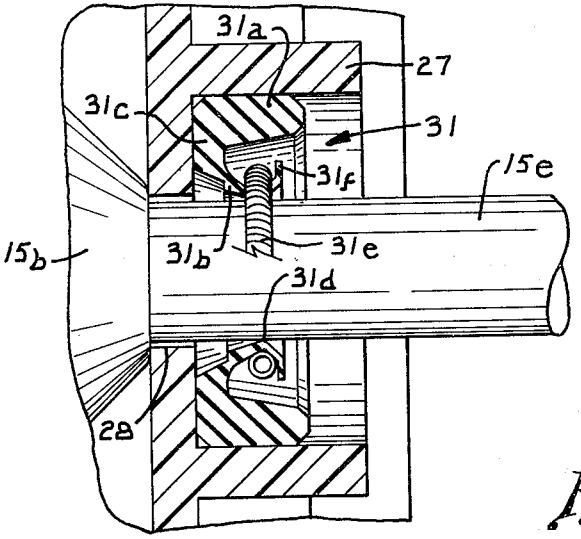
FIG. 4 is an enlarged, fragmentary sectional view of the bearing cup and sealing gasket as shown in FIG. 2.
Figure 3:
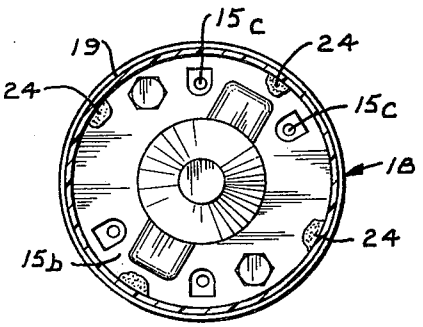
FIG. 3 is an end view of the unsealed DC motor secured within the housing and taken along line 3—3 of FIG. 2 in the direction of the arrows.

It should be understood at the outset that the propulsion unit 14 illustrated in FIGS. 2 through 4 and which comprises a preferred embodiment of the invention, is equally suited for both the hand operated and the remote control types of electric trolling motors.

The propulsion unit 14 includes an unsealed DC electric motor 15 having a generally cylindrical shell **15*a* fitted with end closures 15*b* to enclose the windings and conventional internals (not shown) of a DC motor. The shell 15*a* and end closures 15*b* typically have various openings, generally designated by the numeral 15*c*, which make the motor 15 totally unsuitable for operating while submerged in a fluid. Like-wise, as is conventional in unsealed motors of this genre, a pair of electrical leads 15*d* are connected to the internals for operating a rotatable work shaft 15*e* which extends centrally through the rearward end closure 15*b*.**

Encapsulating the unsealed DC motor 15 is a two piece molded capsule 16 comprising an end cap portion 17 and a body portion 18. The capsule 16 is preferably fabricated from a strong and durable synthetic material and, as those skilled in the art will realize, a wide variety of compositions are suitable for such application. It is essential, however, to the purpose of this invention that the material of fabrication for the housing be moisture impermeable.

The end cap 17 or nose cone portion of the capsule 16 has a tapered bullet or torpedo shape toward the direction of travel of the electrical trolling motor to streamline the shape of the capsule 16 and to facilitate travel through the water. During the assembly of the propulsion unit 14, the end cap 17 is sealed to the body portion 18 by a suitable bonding agent, such as methylene chloride or the like, applied to the lap joint 19 between the end cap 17 and body portion 18 to provide a waterproof joint or seam. The rearward or body portion 18 of the capsule 16 is tubular in shape throughout a major portion thereof, having an inside diameter substantially the same as the outside diameter of the motor shell 15*a*. Integrally molded in the lower region of the body 18 is a fixed rudder 20 or fin member which facilitates the trolling motor operation.

Figure 1:
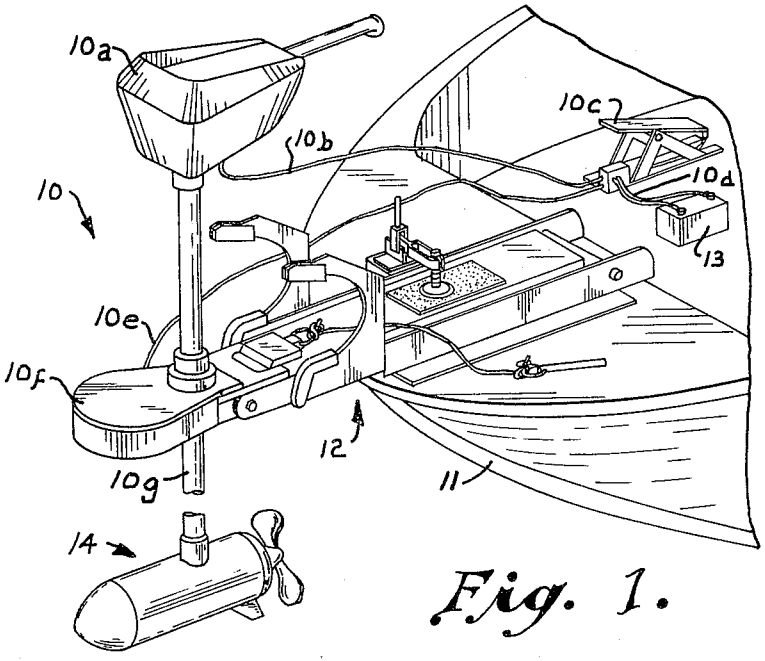
FIG. 1 is a perspective view of a remote control type of electric trolling motor installed on the bow of the boat.

In the upper surface of the body 18 is molded a threaded female fitting 21 which treadably receives the lower end of the elongate shaft of an electric trolling motor, such as shaft 10g of the remote control type 10 shown in FIG. 1. A rubber O-ring 22 seats in the bottom of the fitting 21 to engage the end of the elongate shaft 10*g* and to form a watertight seal. The fitting member 21 communicates with the interior of the housing body 18 to permit the electrical leads 15*d* of the unsealed DC motor 15 to be inserted through the fitting 21 and upwardly through the elongate shaft 10*g* to the upper housing 10a of the trolling motor.

Molded interiorly of the housing body 18 is an abutment wall 23 which engagingly confronts the rearward end closure 15*b* of the motor. In order to prevent vibrational damage to the motor 15, it is securely bonded within the housing body 18 during the assembly of the propulsion unit by small amounts of resin 24 or potting compound placed at various locations around the peripheral edge of the forward end closure 15*b*. The resin 24 also bonds to the interior surface of the housing body 18 to hold the motor 15 to engagement with the abutment wall 23.

The motor 15 is further secured within the capsule 16 by a contact projection 25 centrally molded within the end cap 17 to engage the forward end closure 15*b* of the motor. Interior molded webs or partitions 26 integral with the contact projection 25 provide structural integrity for the nose cone 17.

Being likewise integrally molded with the housing body 18, a bearing cup 27 is disposed in the rearward end of the body 18 and includes a central bore 28 of slightly larger diameter than the diameter of the work shaft 15*e*. The bore 28 receives therethrough the work shaft 15*e* which projects from the rearward end of the capsule 16 to receive a propeller member 29 which is secured to the end of the work shaft 15e by means of a cotter pin 30 or the like.

It should be readily apparent that the bore 28 is of sufficient diameter as to permit unrestricted rotation of the work shaft 15*e* and, consequently, does not form an effective seal with the work shaft 15*e* to exclude water from the interior of the capsule 16. For this reason, there is provided a bearing and sealing gasket 31 which is disposed within the bearing cup 27.

The gasket member 31 is generally doughnut-shaped and has, as shown in FIG. 4, double concentric rings or type of bands 31*a* and 31*b* integrally joined at the bottom 31*c* thereof. The peripheral surface of the outer ring 31*a* is substantially equal in diameter to the diameter of the bearing cup 27. When the gasket 31 is inserted in the bearing cup 27 during the assembly process, a glue or sealant may be applied to the outside and bottom edges of the member 31 which matingly engage the bearing cup 27 in order to provide a waterproof seam. The inner ring of the member 31 forms a resiliently flexible collar 31*b* which is so contoured as to provide inwardly inclined surfaces forming substantially a single contact line 31*d* (i.e., a contact region or area of minimal breadth) encircling the work shaft 15*e*. The diameter of the contact line 31*d* is equal to or slightly smaller than the diameter of the work shaft 15*e* to grip the work shaft and provide a watertight seal while at the same time permitting rotation of the work shaft.

Urging the collar 31*b* to engagement with the work shaft 15e is a doughnut-shaped helical spring 31*e* which is retained on the outside of the collar by an overlying lip portion 31*f* of the collar. The spring 31*e* assists in assuring a waterproof seal and helps maintain such a seal during prolonged usage to compensate for any wear at the area of contact between the collar 31*b* and the work shaft 15*e*. It is naturally desirable that gasket 31 be fabricated from a tough material to minimize wear and fatigue from contact with the rotating work shaft 15*e* and, as those skilled in the art will recognize, a wide variety of hard rubber and synthetic compositions are suitable for such application. It is essential, however, that the material of fabrication be sufficiently elastic to permit flexure of the collar 31*f* and be resilient to seal against the work shaft 15*e* in a watertight seal in a limited area of contact 31*d*. In the latter regard, it is preferable to minimize the area of contact (such as contact line 31*d*) between the work shaft 15*e* and the collar 31*f* while still maintaining an effective water seal in order to minimize the frictional losses of the motor 15.

By encapsulating a motor in the foregoing manner and providing a sealing and gasket member of the nature described, an unsealed motor may be readily adapted for submerged operations such as in electric trolling motors.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described our invention:

1. An underwater propulsion unit for mounting on an elongate shaft of an electric trolling motor, said propulsion unit comprising:

an unsealed electric motor having a water pervious casing which includes a cylindrical shell fitted with an end closure at each end thereof, a rotatable work shaft projecting through one said end closure, and electrical leads disposed through said casing and insertable through said elongate shaft and connectable to a voltage source for powering the motor;

a water impervious housing mounted on the end of said elongate shaft by a watertight connection, said housing encapsulating said casing of said unsealed electric motor and having a circular opening through which said work shaft projects, said housing being a two piece sealed construction with an internal diameter substantially equal to the diameter of said motor casing and with internal buttressing surfaces snugly engaging the end closures of said motor casing to eliminate vibrations and play of the motor within the housing;

a curable sealing agent bonding said motor casing to the interior of said housing to further eliminate vibrational movement of said motor casing relative to said housing;

a resiliently flexible bearing member encircling said work shaft and forming a watertight seal with said housing, said member including a flexure collar encircling said work shaft to prevent the passage of water at the contact interface while permitting rotation of the work shaft; and a propeller member mounted on the end of said work shaft projecting from said housing.

2. The propulsion unit as in claim 1 including an annular spring member concentrically encircling said collar to bias said collar to engagement with said work shaft.

* * * * *